US005705965A

United States Patent [19]

Podvin et al.

[11] Patent Number: 5,705,965

[45] Date of Patent: Jan. 6, 1998

[54] CAVITY TYPE BAND-PASS FILTER WITH COMB-LINE STRUCTURE

[75] Inventors: Dominique Podvin, Bures S/Yvette; Christian Courtois, Briis Sous Forge, both of France

[73] Assignee: Thomson-CSF, Paris, France

[21] Appl. No.: 622,610

[22] Filed: Mar. 26, 1996

[30] Foreign Application Priority Data

Apr. 13, 1995 [FR] France ..... 95 04467

[51] Int. Cl.[6] ..... H01P 1/20

[52] U.S. Cl. ..... 333/203; 333/227

[58] Field of Search ..... 333/202, 203, 333/208, 219, 227

[56] References Cited

U.S. PATENT DOCUMENTS

| | | | |
|---|---|---|---|
| 3,818,389 | 6/1974 | Fisher | 333/208 |
| 3,955,161 | 5/1976 | MacTurk | 333/208 |
| 4,283,697 | 8/1981 | Masuda et al. | 333/219.1 |
| 4,367,473 | 1/1983 | Marin et al. . | |
| 4,386,328 | 5/1983 | Masuda et al. | 333/208 |
| 4,937,533 | 6/1990 | Livingston | 333/203 |
| 5,389,903 | 2/1995 | Piirainen | 333/203 |
| 5,418,509 | 5/1995 | Piirainen | 333/203 |
| 5,423,080 | 6/1995 | Perret et al. . | |
| 5,428,325 | 6/1995 | Jachowski et al. | 333/203 |

FOREIGN PATENT DOCUMENTS

| | | | |
|---|---|---|---|
| 0 364 931 | 4/1990 | European Pat. Off. . | |
| 2 441 927 | 6/1980 | France . | |
| 1 925 610 | 12/1969 | Germany . | |
| 27 14 181 | 10/1978 | Germany . | |
| 30 47 466 | 7/1982 | Germany . | |
| 57-39601 | 3/1982 | Japan | 333/203 |
| 58-170101 | 10/1983 | Japan | 333/203 |

OTHER PUBLICATIONS

K.K. Fujitsu, Patent Abstracts of Japan, vol. 7, No. 174 (E-190) [1319], Aug. 2, 1983.

*Primary Examiner*—Benny Lee
*Assistant Examiner*—Darius Gambino
*Attorney, Agent, or Firm*—Oblon, Spivak, McClelland, Maier & Neustadt, P.C.

[57] ABSTRACT

Cavity filter with comb-line structure having a steep-flanked flanked pass-band. To obtain this steep flank, rejectors are positioned in the vicinity of the access bars of the filter, orthogonally to the teeth of the comb-line structure. The best results are obtained for the flanks corresponding to the high frequencies of the pass-band, namely with rejectors tuned to frequencies higher than the center frequency of the pass-band.

3 Claims, 3 Drawing Sheets

CAVITY TYPE BAND-PASS FILTER WITH COMB-LINE STRUCTURE

BACKGROUND OF THE INVENTION

The present invention relates to cavity type band-pass filters with comb-line structure that are used, in particular, as input filters for radiofrequency receivers.

There are commercially available radio altimeters fitted out with cavity type comb-line structure band-pass filters. The filters used entail only very low insertion losses and do not have spurious pass-bands near their useful pass-band. By contrast, the flanks of the pass-band are those of a Chebyshev filter, i.e. they have little steepness. This causes problems in certain uses, especially for the flank, which limit the high frequencies of the pass-band.

SUMMARY OF THE INVENTION

The aim of the invention is to prevent or at least to reduce this drawback without in any way thereby adding a stop-band filter in series with the band-pass filter considered.

This is obtained by the addition to the filter, within its pack, at one or more appropriately chosen places, respectively, of one or more resonant circuits whose tuning frequency is itself appropriately chosen.

According to the present invention, there is provided a cavity type band-pass filter with comb-line structure, having a center frequency Fo, comprising a parallelepiped pack, with a first end and a second end, two mutually parallel first internal walls and two second internal walls mutually parallel and orthogonal to the first walls and a series assembly with, successively, the first end, a first interval, a first port of the filter, a second interval, comb teeth in series, a third interval, a second port of the filter, a fourth interval and the second end, the ports and the teeth each having a bar mounted perpendicularly to the first walls and n, with n as an integer and $0<n<5$, of the four intervals each comprising a rejector mounted perpendicularly to the second walls.

BRIEF DESCRIPTION OF THE DRAWINGS

The present invention will be understood more clearly and other characteristics will appear from the following description and from the appended figures, of which:

In FIGS. 1 to 4, the corresponding elements are designated by the same symbols.

DETAILED DESCRIPTION

Figure 1:
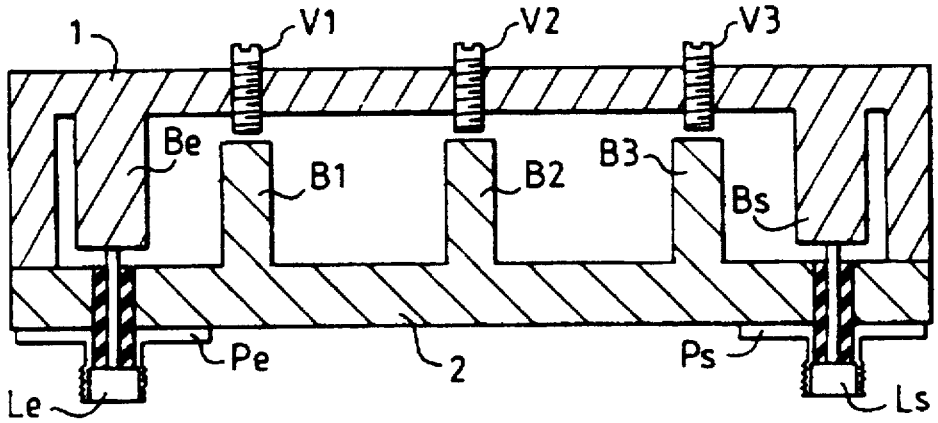
PRIOR ART FIG.1
FIGS. 1 and 2 show schematic views of a filter according to the prior art.
Figure 2:
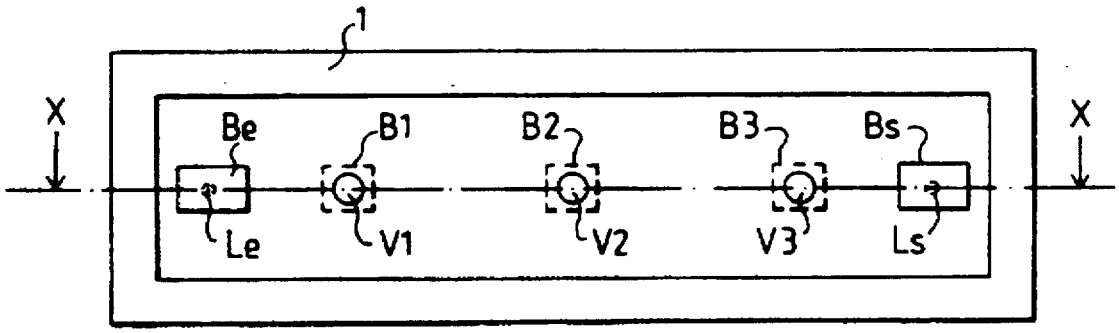
PRIOR ART FIG.2

FIGS. 1 and 2 are respectively a longitudinal sectional view and a bottom view, with the cover removed, of a cavity type band-pass filter, with a three-toothed comb-line structure according to the prior art. In FIG. 2, the section along FIG. 1 has been identified by an axial line corresponding to the projection of the sectional plane in a plane of FIG. 2 by two arrows XX indicating that plane, of the two sectioned planes, which is drawn in FIG. 1.

The filter of FIGS. 1 and 2 comprises a parallelepiped pack made of metal with a hollow part 1 and a lid 2.

Two metal bars, Be, Bs, are fixedly joined to the bottom of the hollow part and are arranged perpendicularly at this bottom. Three metal tuning screws, V1, V2, V3, the heads of which are external to the pack, go through the bottom of the hollow part from one side to the other and perpendicularly to it so as to penetrate into the pack at varying depths. The bar Be, the screws V1, V2, V3 and the bar Bs are aligned in this order.

Two metal connectors Pe, Ps as well as three metal bars B1, B2, B3 are fixedly joined to the lid 2. The connectors are placed in the extension of holes drilled in the lid and the three bars B1, B2, B3 which form the three teeth of the comb are mounted perpendicularly to the lid. Coaxial cables Le, Ls of which only the ends have been shown respectively penetrate the connectors Pe, Ps with their internal conductor which is isolated from the lid by an insulator which comes out of the lid on the side opposite the connector. The external conductor of these cables is in contact with the internal wall of the connector. In FIG. 2, the internal conductors of the cables Le, Ls as well as the bars B1, B2, B3 have been drawn with dashes, in the position that they occupy, within the pack when the lid 1 is placed on the hollow part 2 as shown in FIG. 1. The cables Le, Ls form the input and output conductors of the filter according to FIGS. 1 and 2.

The bars B1, B2, B3 form rejectors, and the screws V1, V2, V3 positioned respectively before the bars B1, B2, B3 form the tuning elements for the resonance frequencies of these resonant circuits. A filter like that of FIGS. 1 and 2 is considered to be a three-cavity filter wherein the cavities are the spaces in the vicinity of each of the bars B1, B2, B3.

In the exemplary embodiment described herein, the pack 1 and the lid 2 as well as the bars Be, B1, B2, B3, Bs are made of a light alloy, chrome-plated on all the internal walls of the waveguide formed by the pack and the lid. As for the tuning screws V1, V2, V3, they are made of beryllium bronze.

The pack of the filter according to FIGS. 1 and 2 has the following dimensions:

external dimensions: length 60 mm, width of the sides parallel to the plane of FIG. 1, 17 mm, width of the sides parallel to the plane of FIG. 2, 18 mm, internal dimensions: length 55 mm, width of the walls parallel to the plane of FIG. 1, 10 mm, width of the walls parallel to the plane of FIG. 2, 12 mm.

Figure 5:
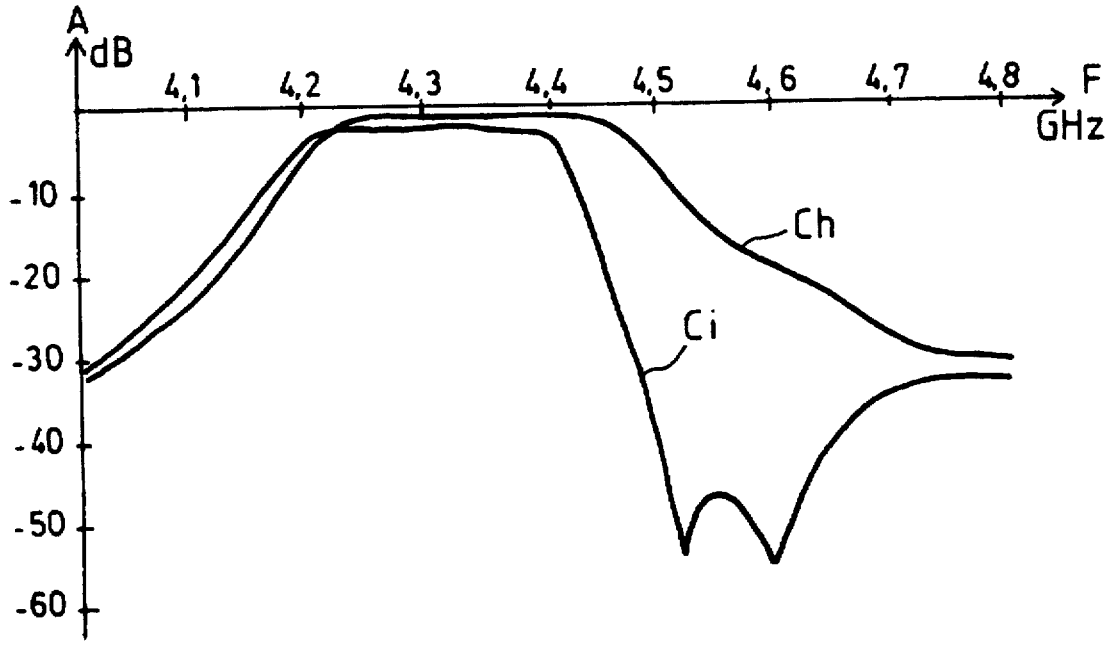
FIG. 5 shows curves pertaining to the filters according to FIGS. 1 to 4.

This is a band-pass filter whose amplitude response A, with respect to the frequency F, represented by the curve Ch according to FIG. 5, is substantially centered on 4.3 GHz. The curve Ch is a standard curve of a Chebyshev filter. This type of filter has a low insertion loss and does not have spurious pass-bands in the cut-off band. In contrast, the slope of the transition between the pass-band and the cut-off band is fairly low, especially compared with that of the Cauer filters. However, there is no known way of making the latter filters in a mechanical structure, namely in the form of cavity filters in a comb-line structure. However, it is possible to make the Cauer filters by means of other technologies, for example by microstrip technology. The drawback here is that in such embodiments, spurious pass-bands appear in the cut-off band.

Figure 3:
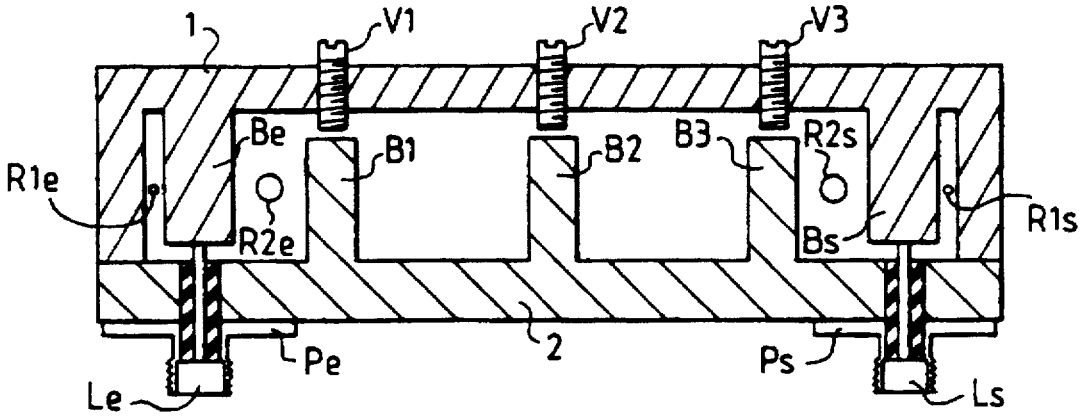
FIGS. 3 and 4 show schematic views of a filter according to the invention.
Figure 4:
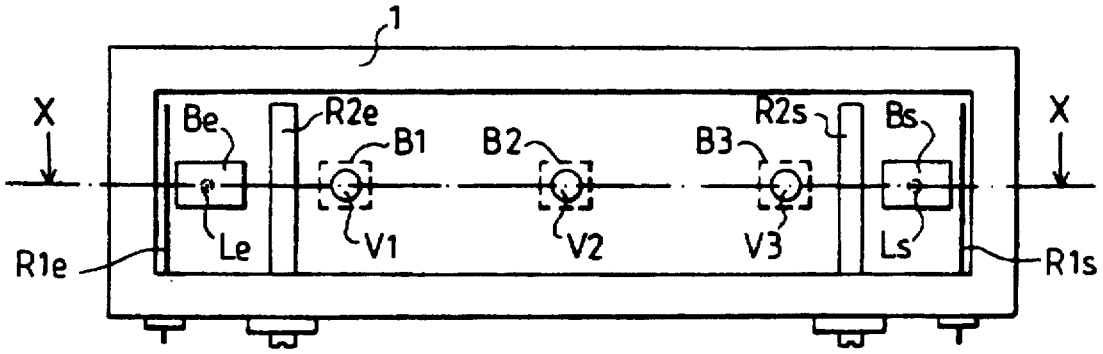

FIGS. 3 and 4 show a pass-band filter obtained by the addition to the filter according to FIGS. 1 and 2 of four rejectors R1*e*, R2*e*, R1*s*, R2*s* which, in the example described, are made of beryllium bronze. In these figures, in fact, it is necessary to show the positions in which it is possible to place rejectors to improve the response of the filter. In the example described, the improvement sought needs only the implementation of the rejectors R2*e* and R2*s*. In other applications, it may prove to be the case that a single rejector is enough or else that it is necessary to use three of them or even all four.

These four rejectors are positioned in the vicinity of the input and output of the filter: R1*e* between the input bar Be and the end of the waveguide neighboring this bar, R2*e* between the input bar Be and the resonant circuit B1–V1, R2*s* between the resonant circuit B3–V3 and the output bar Bs and R1*s* between the output bar Bs and the end of the waveguide neighboring the bar Bs.

The four rejectors are mounted perpendicularly to those walls, among the internal walls of the pack, whose plane is parallel to that of FIG. 1, i.e. they are mounted perpendicularly to the resonant circuits of the filter.

The utility of this choice of the positions of the rejectors, in the neighborhood of the ports of the filter, perpendicularly to the resonant circuits proper of the filter, is that in this way the rejectors truly play their role of rejectors, i.e. they tap the energy at their tuning frequency while at the same time not greatly disturbing the pass-band of the filter as can be seen in FIG. 5.

FIG. 5 shows a view, apart from the curve Ch representing the amplitude/frequency response of the filter according to FIGS. 1 and 2, of a curve Ci representing the amplitude/frequency response of the filter that has been used for the description, namely as stated further above, a filter corresponding to the filter of FIGS. 3, 4 but without the rejectors R1*e*, R1*s*.

The comparison of the curves Ci and Ch shows that the introduction of the rejectors R2*e*, R2*s* in the filter according to FIGS. 1 and 2 makes it possible to improve the filtering in the high part of the pass-band of the filter by about 30 decibels. The pass-band according to the curve Ci is centered on Fo=4.3 GHz and as compared with the one according to the curve Ch it is slightly reduced at the top of the band and slightly wider at the bottom of the band.

In the example described, the rejectors R2*e*, R2*s* are respectively tuned to the resonance frequencies of about 4.5 and 4.6 GHz. This explains the troughs in the curve Ci at these frequencies. These troughs are due to the energy tapped by these resonant circuits at their tuning frequency. It must be noted that the two rejectors are tuned to tuning frequencies higher than the frequencies of the pass-band of the filter. This is because, in fact, they work properly only under these conditions. For tuning frequencies below the pass-band of the filter, a large spurious pass-band appears in the response curve which, in general, is not desirable.

The present invention is not limited to the example described. Thus, the comb-line structure may have a number of teeth different from three. The bars such as Be, Bs and the comb teeth, instead of being perpendicular to the widest of the longitudinal internal walls of the waveguide, may be perpendicular to the narrowest of these walls. In this case, the rejectors, in order to remain orthogonal to them, will be mounted perpendicularly to the widest of the longitudinal internal walls of the waveguide.

Application especially to radio altimeters.

What is claimed is:

1. A cavity type band-pass filter with comb-line structure, having a center frequency Fo, comprising a parallelepiped pack, with a first end and a second end, two mutually parallel first internal walls and two second internal walls mutually parallel and orthogonal to the first walls and a series assembly with, successively, the first end, a first interval, a first port of the filter, a second interval, comb teeth including respective bars in series mounted perpendicularly to the first walls, a third interval, a second port of the filter, a fourth interval and the second end, the ports having respective bars mounted perpendicularly to the first walls, said filter further comprising a number n of rejectors, with n as an integer and $0<n<5$, mounted perpendicularly to the second walls in a corresponding number of said intervals, each of said respective rejectors having a tuned frequency and being configured to reject energy at said tuned frequency.

2. A band-pass filter according to claim 1, wherein at least one of the n rejectors has a tuning frequency higher than Fo.

3. A band-pass filter according to claim 1, wherein n is equal to 2 and wherein the two rejectors each have a tuning frequency higher than Fo and are located respectively in the second interval and in the third interval.

* * * * *